US009401586B1

(12) United States Patent
Nakamura

(10) Patent No.: US 9,401,586 B1
(45) Date of Patent: Jul. 26, 2016

(54) SPARK PLUG

(71) Applicant: NGK Spark Plug Co., LTD., Nagoya (JP)

(72) Inventor: Mai Nakamura, Inazawa (JP)

(73) Assignee: NGK SPARK PLUG CO., LTD., Nagoya (JP)

( * ) Notice: Subject to any disclaimer, the term of this patent is extended or adjusted under 35 U.S.C. 154(b) by 0 days.

(21) Appl. No.: 14/966,722

(22) Filed: Dec. 11, 2015

(30) Foreign Application Priority Data

Jan. 27, 2015 (JP) ..... 2015-013299

(51) Int. Cl.
*H01T 13/20* (2006.01)
*H01T 13/12* (2006.01)

(52) U.S. Cl.
CPC ..... *H01T 13/12* (2013.01); *H01T 13/20* (2013.01)

(58) Field of Classification Search
USPC ..... 123/169 EL
See application file for complete search history.

(56) References Cited

U.S. PATENT DOCUMENTS 5,760,533 A * 6/1998 Saiki ..... H01T 13/34 313/135
6,310,430 B1 10/2001 Moriya
2002/0149308 A1* 10/2002 Suzuki ..... H01T 13/08 313/141
2013/0285534 A1* 10/2013 Ochiai ..... H01T 13/05 313/141
2015/0069902 A1* 3/2015 Kita ..... H01T 13/08 313/130

FOREIGN PATENT DOCUMENTS

JP 11-273827 A 10/1999

* cited by examiner

*Primary Examiner* — Ashok Patel
(74) *Attorney, Agent, or Firm* — Leason Ellis LLP

(57) ABSTRACT

A spark plug includes: a metal shell including a tool engagement portion and having a through hole; an insulator disposed in the through hole of the metal shell; and a metal terminal including: a trunk portion disposed in an axial hole of the insulator; a flange portion having a larger diameter than the trunk portion; and a head portion having a smaller diameter than the flange portion. A minimum thickness of an exposed portion of the insulator is equal to or less than 2.5 mm. A diameter difference between the maximum outer diameter of the head portion and the maximum outer diameter of the tool engagement portion is equal to or less than 9 mm, or a diameter difference between the maximum outer diameter of the exposed portion and the maximum outer diameter of the head portion is equal to or less than 2.3 mm.

6 Claims, 7 Drawing Sheets

FIRST EMBODIMENT

SECOND EMBODIMENT

SPARK PLUG

This application claims the benefit of Japanese Patent Application No. 2015-013299, filed Jan. 27, 2015, which is incorporated herein by reference in its entity.

FIELD OF THE INVENTION

The present invention relates to a spark plug used for ignition in an internal combustion engine or the like.

BACKGROUND OF THE INVENTION

In a spark plug used for ignition in an internal combustion engine or the like, when a voltage is applied to a center electrode and a ground electrode which are insulated from each other by an insulator, a spark occurs in a spark gap formed between a front end portion of the center electrode and a front end portion of the ground electrode (e.g., Japanese Patent Application Laid-Open (kokai) No. H11-273827).

In recent years, reduction in the diameter and size of a spark plug is desired from the standpoint of reducing the size of an internal combustion engine and the standpoint of improving the design freedom.

Problems to be Solved by the Invention

However, there is a possibility that as the wall thickness of an insulator decreases with reduction in the diameter and size of a spark plug, it becomes difficult to ensure desired strength of the insulator, for example, ensure desired resistance to breakage of the insulator which can occur when the spark plug falls and collides against the floor or the like.

The present specification discloses a technique to be able to improve the resistance to breakage of an insulator of a spark plug.

SUMMARY OF THE INVENTION

Means for Solving the Problems

The technique disclosed in the present specification can be embodied in the following application examples.

Application Example 1

A spark plug comprising:

a metal shell including a tool engagement portion for engaging a mounting tool, the metal shell having a through hole extending therethrough in a direction of an axial line;

an insulator disposed in the through hole of the metal shell and having an axial hole extending in the direction of the axial line; and a metal terminal including: a trunk portion disposed in the axial hole of the insulator; a flange portion having a larger diameter than the trunk portion and in contact with a rear end surface of the insulator; and a head portion having a smaller diameter than the flange portion and located at a rear side of the flange portion, wherein a virtual line between a rear end of a maximum outer diameter portion of the head portion and a rear end of a maximum outer diameter portion of the tool engagement portion defines a shortest distance between the two rear ends, the maximum outer diameter portion of the tool engagement portion is a portion where a circumscribed circle of the tool engagement portion has a largest diameter, the virtual line does not intersect an exposed portion of the insulator, which is exposed from the metal shell toward the rear side, the exposed portion has a contact portion that contacts the trunk portion, and a minimum thickness in a radial direction of the contact portion is equal to or less than 2.5 mm, and a diameter difference between the maximum outer diameter of the tool engagement portion and the maximum outer diameter of the head portion is equal to or less than 9 mm.

According to the above configuration, even when the minimum thickness in the radial direction of the contact portion of the exposed portion is equal to or less than 2.5 mm, since the diameter difference between the maximum outer diameter of the tool engagement portion and the maximum outer diameter of the head portion of the metal terminal is equal to or less than 9 mm, a shock to the insulator at the time of fall or the like can be alleviated. Therefore, resistance to breakage of the insulator can be improved.

Application Example 2

The spark plug described in the application example 1, wherein the maximum outer diameter of the head portion is smaller than a maximum outer diameter of the exposed portion.

With this configuration, a reduction in adhesion between a plug cap and the exposed portion of the insulator can be suppressed to suppress occurrence of flash over.

Application Example 3

The spark plug described in the application example 2, wherein the diameter difference between the maximum outer diameter of the tool engagement portion and the maximum outer diameter of the head portion is equal to or greater than 5 mm.

With this configuration, an excessive decrease in the diameter difference between the outer diameter of the tool engagement portion and the outer diameter of the exposed portion can be suppressed, thus fixing (e.g., fixing by means of crimping) of the insulator to the metal shell can be appropriately performed, and further airtightness of the spark plug can be ensured.

Application Example 4

A spark plug comprising:

a metal shell including a tool engagement portion for engaging a mounting tool, the metal shell having a through hole extending therethrough in a direction of an axial line;

an insulator disposed in the through hole of the metal shell and having an axial hole extending in the direction of the axial line; and a metal terminal including: a trunk portion disposed in the axial hole of the insulator; and a head portion having a larger diameter than the trunk portion and in contact with a rear end surface of the insulator, wherein a virtual line between a rear end of a maximum outer diameter portion of the head portion and a rear end of a maximum outer diameter portion of the tool engagement portion defines a shortest distance between the two rear ends, the maximum outer diameter portion of the tool engagement portion is a portion where a circumscribed circle of the tool engagement portion has a largest diameter, the virtual line intersects an exposed portion of the insulator, which is exposed from the metal shell toward the rear side, the exposed portion has a contact portion that contacts the trunk portion, and a minimum thickness in a radial direction of the contact portion is equal to or less than 2.5 mm, and a diameter difference between a maximum outer diameter of the exposed portion and the maximum outer diameter of the head portion is equal to or less than 2.3 mm.

According to the above configuration, even when the minimum thickness in the radial direction of the contact portion of the exposed portion is equal to or less than 2.5 mm, since the diameter difference between the maximum outer diameter of the exposed portion of the insulator and the maximum outer diameter of the head portion of the metal terminal is equal to or less than 2.3 mm, a shock to the insulator at the time of fall or the like can be alleviated. Therefore, resistance to breakage of the insulator can be improved.

Application example 5

The spark plug described in the application example 4, wherein the maximum outer diameter of the head portion is smaller than the maximum outer diameter of the exposed portion, and the diameter difference between the maximum outer diameter of the exposed portion and the maximum outer diameter of the head portion is equal to or greater than 1 mm.

With this configuration, protrusion of the head portion of the metal terminal radially outward of the outer peripheral surface of the exposed portion of the insulator due to tolerance variations during production can be suppressed. Therefore, a reduction in adhesion between the plug cap and the exposed portion of the insulator can be suppressed, and thus occurrence of flash over can be suppressed.

The present invention can be embodied in various forms. For example, the present invention may be embodied in forms such as a spark plug, an ignition device using the spark plug, an internal combustion engine equipped with the spark plug, and an internal combustion engine equipped with the ignition device using the spark plug.

BRIEF DESCRIPTION OF THE DRAWINGS

These and other features and advantages of the present invention will become more readily appreciated when considered in connection with the following detailed description and appended drawings, wherein like designations denote like elements in the various views, and wherein.

DETAILED DESCRIPTION OF THE INVENTION

A. First Embodiment

A-1. Configuration of Spark Plug

Figure 1:
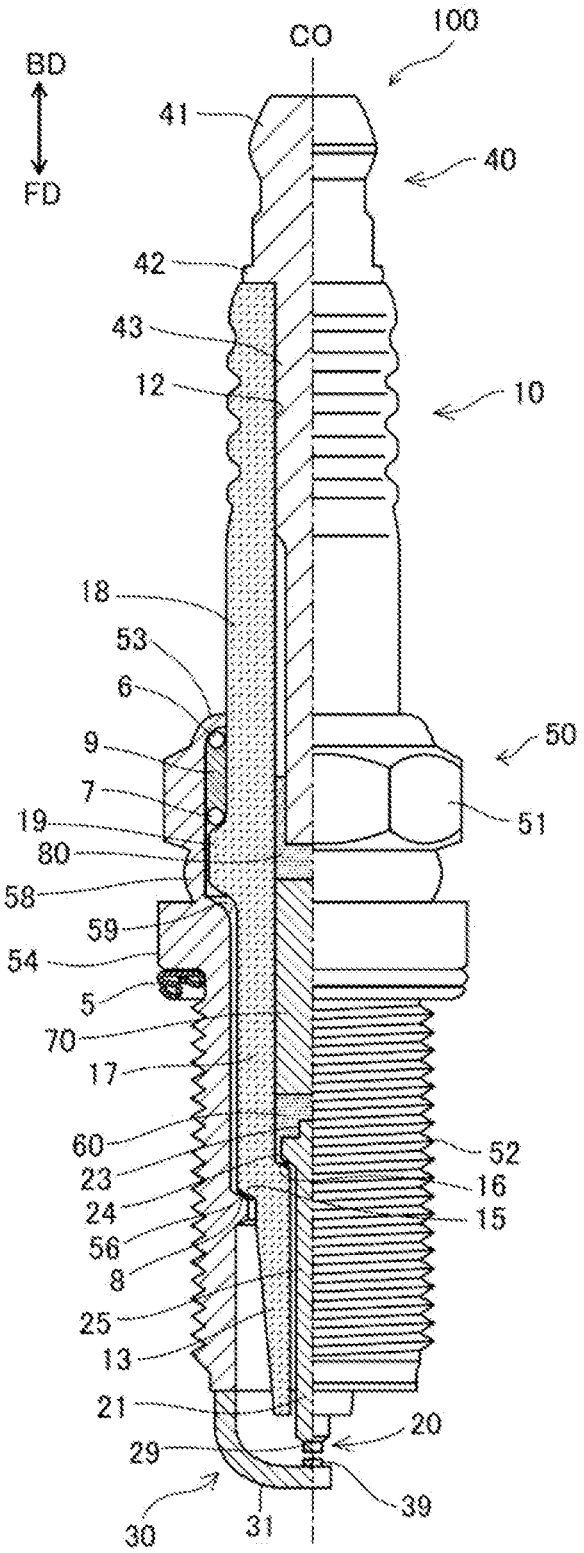
FIG. 1 is a view showing the entirety of a spark plug 100 according to a first embodiment.

Hereinafter, a mode of the present invention will be described on the basis of an embodiment. FIG. 1 is a view showing the entirety of a spark plug 100 according to a first embodiment. The right side of an axial line CO in FIG. 1 shows an external view of the spark plug 100, and the left side of the axial line CO shows a cross-sectional view of the spark plug 100 taken along a plane including the axial line CO. In FIG. 1, an alternate long and short dashed line indicates the axial line CO of the spark plug 100. A direction parallel to the axial line CO (an up-down direction in FIG. 1) is also referred to as an axial direction. The radial direction of a circle centered on the axial line CO is also referred to merely as a "radial direction", and the circumferential direction of the circle centered on the axial line CO is also referred to merely as a "circumferential direction". In FIG. 1, the downward direction is also referred to as a front end direction FD, and the upward direction is also referred to as a rear end direction BD. In FIG. 1, the lower side is referred to as a front side of the spark plug 100, and the upper side is referred to as a rear side of the spark plug 100.

The spark plug 100 includes an insulator (ceramic insulator) 10, a center electrode 20, a ground electrode 30, a metal terminal 40, and a metal shell 50.

The insulator (ceramic insulator) 10 is formed by baking alumina or the like. The insulator 10 is a substantially cylindrical member having an axial hole 12 which is a through hole extending along the axial direction and through the insulator 10. The insulator 10 includes a flange portion 19, a rear trunk portion 18, a front trunk portion 17, a step portion 15, and a leg portion 13. The rear trunk portion 18 is located at the rear side with respect to the flange portion 19 and has an outer diameter smaller than the outer diameter of the flange portion 19. The front trunk portion 17 is located at the front side with respect to the flange portion 19 and has an outer diameter smaller than the outer diameter of the flange portion 19. The leg portion 13 is located at the front side with respect to the front trunk portion 17, has an outer diameter smaller than the outer diameter of the front trunk portion 17, and is reduced in diameter from the rear side toward the front end direction FD. The leg portion 13 is exposed to a combustion chamber of an internal combustion engine (not shown) when the spark plug 100 is mounted on the internal combustion engine. The step portion 15 is formed between the leg portion 13 and the front trunk portion 17.

The metal shell 50 is formed from a conductive metal material (e.g., a low-carbon steel material) and is a cylindrical metal member for fixing the spark plug 100 to an engine head (not shown) of the internal combustion engine. The metal shell 50 has a through hole 59 extending along the axial line CO and through the metal shell 50. The insulator 10 is disposed and held within the through hole 59 of the metal shell 50. The front end of the insulator 10 is exposed to the front side with respect to the front end of the metal shell 50. The rear end of the insulator 10 is exposed to the rear side with respect to the rear end of the metal shell 50.

The metal shell 50 includes: a tool engagement portion 51 for engaging a mounting tool (specifically, a spark plug wrench) in mounting the spark plug 100 to the engine head; a mounting screw portion 52 for mounting the spark plug 100 to the internal combustion engine; and a flange-like seat portion 54 formed between the tool engagement portion 51 and the mounting screw portion 52.

An annular gasket 5 which is formed by bending a metal plate is inserted between the mounting screw portion 52 and the seat portion 54 of the metal shell 50. The gasket 5 seals a gap between the spark plug 100 and the internal combustion engine (engine head) when the spark plug 100 is mounted on the internal combustion engine.

The metal shell 50 further includes: a thin crimp portion 53 provided at the rear side of the tool engagement portion 51;

and a thin compressive deformation portion 58 provided between the seat portion 54 and the tool engagement portion 51. Annular line packings 6 and 7 are disposed in an annular region formed between: the inner peripheral surface of a portion of the metal shell 50 from the tool engagement portion 51 to the crimp portion 53; and the outer peripheral surface of the rear trunk portion 18 of the insulator 10. The space between the two line packings 6 and 7 in this region is filled with powder of a talc 9. The rear end of the crimp portion 53 is bent radially inward and fixed to the outer peripheral surface of the insulator 10. The compressive deformation portion 58 of the metal shell 50 compressively deforms by the crimp portion 53, which is fixed to the outer peripheral surface of the insulator 10, being pressed toward the front side during manufacturing. The insulator 10 is pressed within the metal shell 50 toward the front side via the line packings 6 and 7 and the talc 9 due to the compressive deformation of the compressive deformation portion 58. The step portion 15 (ceramic insulator side step portion) of the insulator 10 is pressed by a step portion 56 (metal shell side step portion), which is formed on the inner periphery of the mounting screw portion 52 of the metal shell 50, via an annular plate packing 8 made of metal. As a result, the plate packing 8 and the talc 9 prevent gas within the combustion chamber of the internal combustion engine from leaking to the outside through a gap between the metal shell 50 and the insulator 10. Thus, airtightness of the spark plug 100 is ensured.

The center electrode 20 includes: a bar-shaped center electrode body 21 extending in the axial direction; and a columnar center electrode tip 29 joined to the front end of the center electrode body 21. The center electrode body 21 is disposed within the axial hole 12 and at a front portion of the insulator 10. The center electrode body 21 is formed from, for example, nickel or an alloy containing nickel as a principal component. In the present embodiment, the center electrode body 21 is formed from INCONEL 600 ("INCONEL" is a registered trademark). The center electrode body 21 may include a core material which is buried therein and formed from an alloy containing copper as a principal component and having more excellent thermal conductivity than nickel or an alloy containing nickel as a principal component.

The center electrode body 21 includes: a flange portion 24 (electrode flange portion) provided at a predetermined position in the axial direction; a head portion 23 (electrode head portion) which is a portion at the rear side with respect to the flange portion 24; and a leg portion 25 (electrode leg portion) which is a portion at the front side with respect to the flange portion 24. The flange portion 24 is supported by a step portion 16 of the insulator 10. A front end portion of the leg portion 25, that is, the front end of the center electrode body 21 protrudes frontward of the front end of the insulator 10.

The center electrode tip 29 is joined to the front end of the center electrode body 21 (the front end of the leg portion 25), for example, by means of laser welding. The center electrode tip 29 is formed from a material containing, as a principal component, a noble metal having a high melting point. As the material of the center electrode tip 29, for example, iridium (Ir) or an alloy containing Ir as a principal component is used.

The ground electrode 30 includes: a ground electrode body 31 joined to the front end of the metal shell 50; and a columnar ground electrode tip 39.

The ground electrode body 31 is a bent bar-shaped body having a quadrangular cross-section. The rear end of the ground electrode body 31 is joined to the front end surface of the metal shell 50. Thus, the metal shell 50 and the ground electrode body 31 are electrically connected to each other. The front end of the ground electrode body 31 is a free end.

The ground electrode body 31 is formed by using a metal having high corrosion resistance, for example, a nickel alloy. In the present embodiment, the ground electrode body 31 is formed by using INCONEL 601. The ground electrode body 31 may include therein a core material formed from a metal having a higher coefficient of thermal conductivity than a nickel alloy, such as copper.

The front end surface of the ground electrode tip 39 is joined to a surface of a bent front end portion of the ground electrode body 31 which surface faces the center electrode 20, for example, by means of resistance welding. The ground electrode tip 39 is formed by using, for example, platinum (Pt) or an alloy containing Pt as a principal component. In the present embodiment, the ground electrode tip 39 is formed by using a PT-10Ni alloy or the like.

The rear end surface of the ground electrode tip 39 and the front end surface of the center electrode tip 29 form a gap in which spark discharge occurs. The vicinity of the gap is also referred to a firing end of the spark plug 100.

The metal terminal 40 is a bar-shaped member extending in the axial direction. The metal terminal 40 is formed from a conductive metal material (e.g., low-carbon steel), and a metal layer (e.g., an Ni layer) for anticorrosion is formed on the surface of the metal terminal 40 by means of plating or the like. The metal terminal 40 includes: a trunk portion 43 disposed in the axial hole 12 of the insulator 10; a flange portion 42 located at the rear side with respect to the trunk portion 43; and a head portion 41 located at the rear side with respect to the flange portion 42.

A resistor 70 for reducing electric wave noise generated when spark occurs is disposed within the axial hole 12 of the insulator 10 and between the front end of the metal terminal 40 (the front end of the trunk portion 43) and the rear end of the center electrode 20 (the rear end of the head portion 23). The resistor 70 is formed from, for example, a composition containing glass particles as a principal component, ceramic particles other than glass, and a conductive material. Within the axial hole 12, a gap between the resistor 70 and the center electrode 20 is filled with a conductive seal 60, and a gap between the resistor 70 and the metal terminal 40 is filled with a conductive seal 80. Each of the conductive seals 60 and 80 is formed from, for example, a composition containing glass particles of a $B_2O_3$—$SiO_2$-based material or the like and metal particles (Cu, Fe, etc.).

A-2. Configuration at Rear Side of Spark Plug 100

Figure 2A:
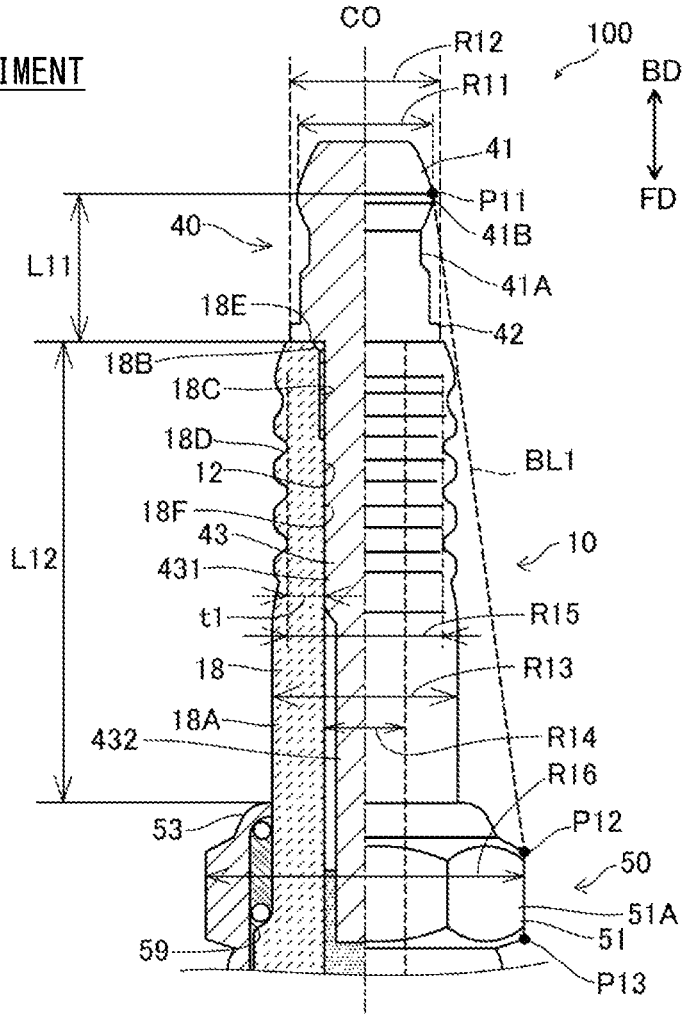
FIGS. 2(A) and 2(B) are views showing a configuration at a rear side of the spark plug 100.
Figure 2B:
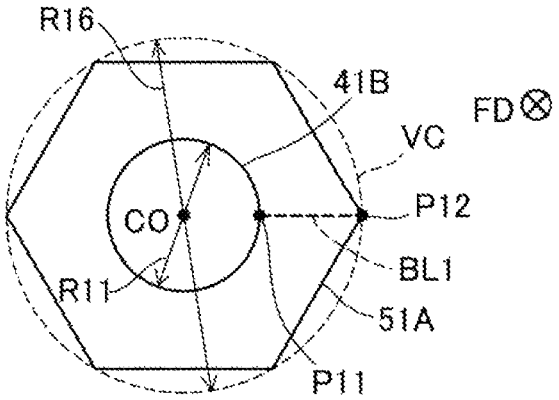

The configuration at the rear side of the spark plug 100 will be described in more detail with reference to FIGS. 2(A) and 2(B). FIGS. 2(A) and 2(B) are views showing the configuration at the rear side of the spark plug 100. FIG. 2(A) shows an enlarged view of a portion at the rear side of the spark plug 100 in FIG. 1.

Of the insulator 10 disposed in the through hole 59 of the metal shell 50, a portion 18A of the rear trunk portion 18 at the rear side is exposed from the rear end of the through hole 59 to the rear side. The portion 18A of the rear trunk portion 18 at the rear side is also referred to as an exposed portion 18A of the insulator 10. The length of the exposed portion 18A in the axial direction is denoted by L12. A rear end portion of the inner peripheral surface of the exposed portion 18A which inner peripheral surface forms the axial hole 12 has a counter bore 18B and a portion 18C which is located at the front side of the counter bore 18B and has a female thread formed thereon. A portion 18F, at the front side with respect to the portion 18C, of the inner peripheral surface of the exposed portion 18A which inner peripheral surface forms the axial hole 12 is a portion with which the trunk portion 43 of the metal terminal 40 is in contact, as described later.

A rear portion of the side surface of the exposed portion 18A has a plurality of grooves 18D formed over the entire periphery thereof in the circumferential direction. Due to the plurality of grooves 18D, the rear portion of the side surface of the exposed portion 18A has a wave shape along the axial direction. A portion having a maximum outer diameter R13 of the exposed portion 18A is a front portion having an outer peripheral surface on which no grooves 18D are formed.

The trunk portion 43 of the metal terminal 40 includes a large-diameter portion 431 and a small-diameter portion 432 which has a smaller diameter than the large-diameter portion 431 and is located at the front side with respect to the large-diameter portion 431. The large-diameter portion 431 has a diameter slightly smaller than the inner diameter of the axial hole 12 of the insulator 10, and a portion of the side surface of the large-diameter portion 431 is in contact with the portion 18F of the inner peripheral surface of the exposed portion 18A which inner peripheral surface forms the axial hole 12, due to occurrence of distortion or displacement (not shown) when the trunk portion 43 is inserted into the axial hole 12. The small-diameter portion 432 of the trunk portion 43 is not in contact with the inner peripheral surface of the insulator 10 which inner peripheral surface forms the axial hole 12.

Here, a minimum thickness t1 of the exposed portion 18A is defined. The minimum thickness t1 is the minimum value of the thickness, in the radial direction, of a portion of the exposed portion 18A which portion is in contact with the trunk portion 43 (the portion 18F of the exposed portion 18A in the example of FIG. 1). The minimum thickness t1 can be defined as t1=(R15−R14)/2. R14 is the inner diameter of the exposed portion 18A, that is, the diameter of the axial hole 12 of the exposed portion 18A. R15 is the minimum outer diameter of the portion of the exposed portion 18A which portion is in contact with the trunk portion 43. In the case where a plurality of grooves 18D are formed on the exposed portion 18A, the outer diameter R15 is the outer diameter (also referred to as groove portion outer diameter R15) at a portion closest to the axial line CO, among the bottoms of the plurality of grooves 18D.

The flange portion 42 of the metal terminal 40 has a larger outer diameter than the trunk portion 43. The flange portion 42 is in contact with a rear end surface 18E of the insulator 10. The head portion 41 of the metal terminal 40 has a smaller outer diameter than the flange portion 42. As is understood from the above, a maximum outer diameter R12 of the flange portion 42 is the maximum outer diameter of the metal terminal 40. The maximum outer diameter R12 of the metal terminal 40 is smaller than the maximum outer diameter R13 of the exposed portion 18A (R12<R13). As a result, the metal terminal 40 does not protrude radially outward of the exposed portion 18A.

A plug cap (not shown) to which a high-voltage cable is connected is mounted on the head portion 41 of the flange portion 42. In the example of FIG. 1, the head portion 41 has a groove 41A for connection to a connection tool of the plug cap, and a portion 41B thereof at the rear side of the groove 41A is a portion having a maximum outer diameter R11 of the head portion 41. As described above, R11<R12<R13. The length in the axial direction from the rear end of the insulator 10 (the rear end of the exposed portion 18A) to the rear end of the portion 41B having the maximum outer diameter R11 of the head portion 41 is denoted by L11.

In the tool engagement portion 51 of the metal shell 50, a portion in a range in the axial direction from a point P12 to a point P13 in FIG. 2(A) is a maximum outer diameter portion 51A of which the diameter of the circumscribed circle is the largest. FIG. 2(B) is a view of the spark plug 100 as seen from the rear side toward the front end direction FD. FIG. 2(B) is simplified to avoid complication of the drawing, and only the outer peripheral surface of the portion 41B having the maximum outer diameter R11 of the head portion 41 of the metal terminal 40 and the outer peripheral surface of the maximum outer diameter portion 51A of the tool engagement portion 51 are shown therein. The maximum outer diameter portion 51A has a prism shape having a regular hexagon shape as seen from the rear side toward the front end direction FD. A circumscribed circle VC which is circumscribed about the tool engagement portion 51 on a plane which is perpendicular to the axial line CO and intersects the maximum outer diameter portion 51A is a circle passing through the apexes of the regular hexagon. The diameter of the circumscribed circle VC is denoted by R16. The diameter R16 of the circumscribed circle VC is, for example, 10 mm to 16 mm.

Here, a virtual line BL1 which connects the rear end of the portion 41B having the maximum outer diameter of the head portion 41 and the rear end of the maximum outer diameter portion 51A to each other at the shortest distance is a broken line connecting a point P11 and the point P12 to each other in the cross-section shown in FIG. 2(A). In the spark plug 100 according to the first embodiment, the virtual line BL1 does not intersect the exposed portion 18A. Such a virtual line BL1 can be drawn in any cross-section passing through the axial line CO, and the virtual line BL1 does not intersect the exposed portion 18A in any cross-section. In other words, the entirety of the exposed portion 18A falls within a truncated cone obtained by rotating the virtual line BL1 in the cross-section shown in FIG. 2(A) about the axial line CO. In addition, a portion of the metal shell 50 at the front side with respect to the tool engagement portion 51 also does not intersect the virtual line BL1.

The diameter difference ΔR1=(R16−R11) between the diameter R16 of the circumscribed circle VC of the maximum outer diameter portion 51A and the maximum outer diameter R11 of the head portion 41 is preferably equal to or greater than 5 mm. For example, when the diameter R16 is 12 mm, the maximum outer diameter R11 of the head portion 41 is set to 7 mm or less. When the diameter R16 is 14 mm, the maximum outer diameter R11 of the head portion 41 is set to 9 mm or less.

A-3: Evaluation Test

In an evaluation test, a drop test for a plurality of kinds of samples of spark plugs (also referred to as evaluation samples) was carried out for confirming resistance to breakage of the insulator 10 of the spark plug 100 according to the first embodiment described above.

The items common to each evaluation sample used in the test are as follows.

Maximum outer diameter R13 of the exposed portion 18A: 9 mm.

Groove portion outer diameter R15 of the exposed portion 18A: 7.5 mm.

Length L12 of the exposed portion 18A in the axial direction: 25 mm.

Length L11 in the axial direction to the rear end of the portion 41B having the maximum outer diameter R11 of the head portion 41: 8.5 mm.

Maximum outer diameter R12 of the metal terminal 40: 7.5 mm.

Material of the insulator 10: a ceramic material composed of 90% by weight of $Al_2O_3$ and 10% by weight of a sintering aid ($SiO_2$, CaO, MgO, BaO).

As the evaluation samples, samples in which the minimum thickness t1 of the exposed portion 18A was set to eight kinds of thicknesses, that is, to 1.5 mm, 1.8 mm, 2.0 mm, 2.2 mm, 2.5 mm, 2.7 mm, 3.0 mm, and 3.2 mm, respectively were prepared. The minimum thickness t1 was changed by changing the diameter R14 of the axial hole 12 of the exposed portion 18A.

Furthermore, regarding the samples having the respective minimum thicknesses t1, samples in which the diameter difference ΔR1=(R16−R11) between the diameter R16 of the circumscribed circle VC of the maximum outer diameter portion 51A and the maximum outer diameter R11 of the head portion 41 was set to five kinds of values, that is, to 5 mm, 7 mm, 9 mm, 10 mm, and 12 mm, respectively were prepared. The diameter difference ΔR1 was changed by setting the diameter R16 of the circumscribed circle VC of the maximum outer diameter portion 51A and the maximum outer diameter R11 of the head portion 41 in the following combinations.

Samples of ΔR1=5 mm: (R16=12.4 mm, R11=7.4 mm)
Samples of ΔR1=7 mm: (R16=14.4 mm, R11=7.4 mm)
Samples of ΔR1=9 mm: (R16=15.4 mm, R11=6.4 mm)
Samples of ΔR1=10 mm: (R16=16.4 mm, R11=6.4 mm)
Samples of ΔR1=12 mm: (R16=18.4 mm, R11=6.4 mm)

As described above, 40 kinds of samples different from each other in at least one of the minimum thickness t1 and the diameter difference ΔR1 were prepared. In each kind of the sample, the virtual line BL1 does not intersect the exposed portion 18A.

Figure 3:
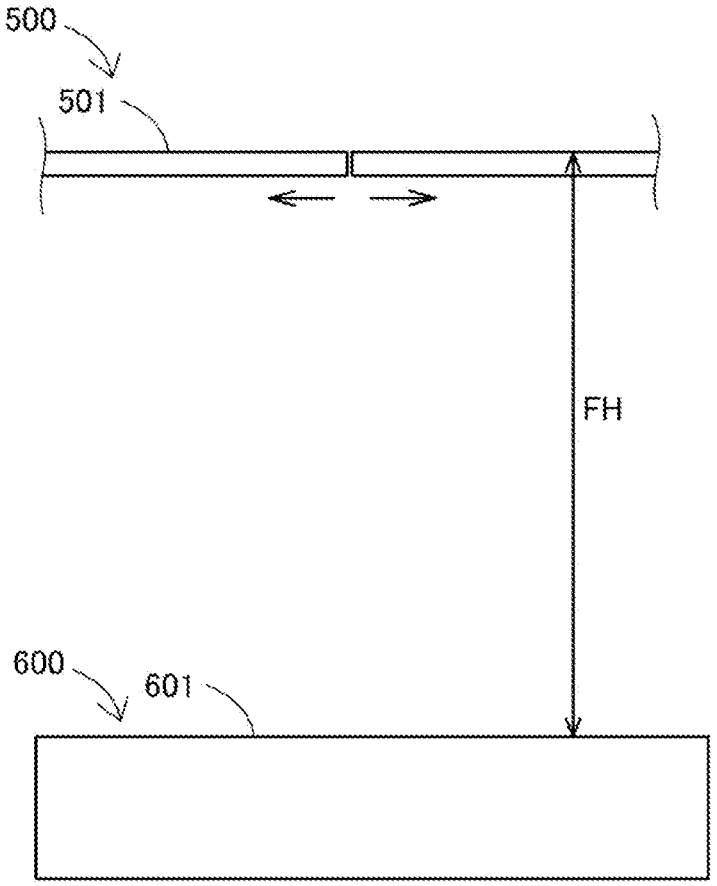
FIG. 3 is a schematic diagram of a testing device.

FIG. 3 is a schematic diagram of a testing device. In the drop test, a shutter 500 including horizontal opening/closing plates was installed above a metal plate 600, which is installed horizontally and has a sufficient thickness, such that a fall height FH was adjustable. The fall height FH is the distance in the vertical direction from an upper surface 501 of the opening/closing plates to an upper surface 601 of the metal plate 600. Then, the fall height FH was set to a specified fall height FH, and a sample was placed on the upper surface 501 of the opening/closing plates such that the axial direction of the sample was substantially horizontal. Thereafter, the shutter 500 was changed at a high speed from a closed state to an opened state, thereby causing the sample to freely fall with the axial direction being substantially horizontal to collide against the upper surface 601 of the metal plate 600.

In this test, a plurality of samples of one kind were prepared, and the drop test was carried out on each sample while the fall height FH was raised from 20 cm sequentially in increments of 5 cm. It was confirmed whether breakage occurred in the exposed portion 18A of each sample. Of the fall heights FH at which breakage occurred in the exposed portion 18A of the sample after the fall, the lowest height was identified as a breakage occurrence height. The breakage that occurred in the exposed portion 18A of the sample was breakage (also referred to as longitudinal breakage) in which a crack runs from the rear end of the exposed portion 18A along the axial direction.

Figure 4:
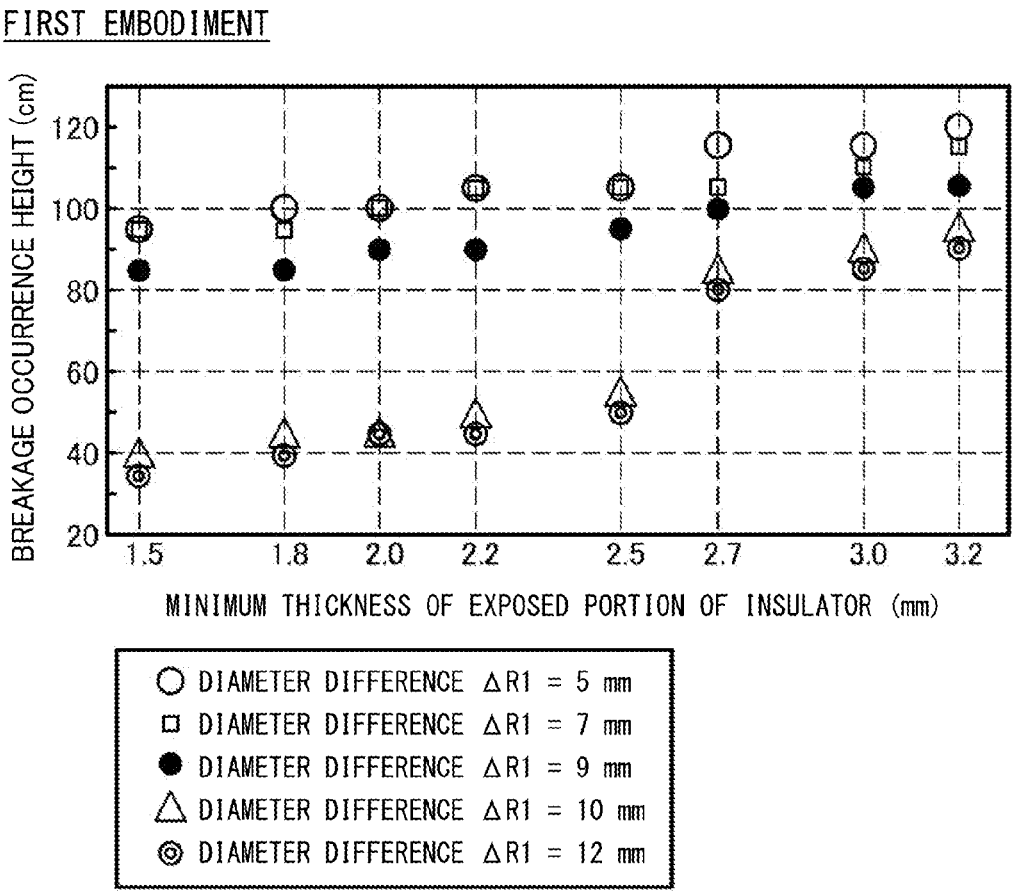
FIG. 4 is a graph showing test results.

FIG. 4 is a graph showing test results. As shown in FIG. 4, when eight kinds of samples that are the same in the diameter difference ΔR1 and different from each other in the minimum thickness t1 are compared, the samples having the larger minimum thickness t1 tended to have a higher breakage occurrence height. That is, when the diameter differences ΔR1 were equal to each other, the samples having the larger minimum thickness t1 had higher resistance to breakage. This tendency was common to the sample groups of all the diameter differences ΔR1.

In addition, when five kinds of samples that are the same in the minimum thickness t1 and different from each other in the diameter difference ΔR1 are compared, the breakage occurrence height tended to be higher as the diameter difference ΔR1 was smaller. That is, when the minimum thicknesses t1 were equal to each other, the resistance to breakage was higher as the diameter difference ΔR1 was smaller. This tendency was common to the sample groups of all the minimum thicknesses t1.

This reason is inferred as follows. Breakage occurs in the exposed portion 18A when a shock in the radial direction is applied mainly to the exposed portion 18A. This is because the thickness of the exposed portion 18A in the radial direction is much smaller than the length thereof in the axial direction. In each sample, as described above, the virtual line BL1 (FIGS. 2(A) and 2(B)) does not intersect the exposed portion 18A. Therefore, the exposed portion 18A does not collide directly against the upper surface 601 of the metal plate 600. The case where a great shock in the radial direction is applied to the exposed portion 18A is thought to be the case where a shock in the radial direction is applied to the head portion 41 of the metal terminal 40 and this shock is applied to the exposed portion 18A via the trunk portion 43 of the metal terminal 40. The case where a shock in the radial direction is applied to the head portion 41 of the metal terminal 40 is mainly the case where the sample falls with the axial direction being substantially horizontal as in the present drop test. In this case, the tool engagement portion 51 of the metal shell 50 collides against the upper surface 601 of the metal plate 600 earlier than the head portion 41 of the metal terminal 40. Thereafter, the sample rotates with the maximum outer diameter portion 51A of the tool engagement portion 51 as a fulcrum, so that the portion 41B having the maximum outer diameter R11 of the head portion 41 of the metal terminal 40 collides against the upper surface 601 of the metal plate 600. As the stroke of the rotation is longer, the collision speed of the head portion 41 is higher, and the shock of the collision is also greater. As the diameter difference ΔR1 is smaller, the stroke of the rotation after the collision of the tool engagement portion 51 of the metal shell 50 against the upper surface 601 until the collision of the portion 41B having the maximum outer diameter R11 of the head portion 41 against the upper surface 601 is shorter. As a result, as the diameter difference ΔR1 is smaller, the shock in the radial direction applied to the head portion 41 of the metal terminal 40 is smaller. Thus, it is thought that as the diameter difference ΔR1 is smaller, the resistance to breakage is higher.

Furthermore, five kinds of samples that are the same in the minimum thickness t1 will be compared in detail. The samples having the diameter difference ΔR1 of 9 mm or less had much higher resistance to breakage than the samples having the diameter difference ΔR1 of larger than 9 mm. For example, attention will be paid to the sample group of the minimum thickness t1=1.5 mm. In this sample group, the difference in breakage occurrence height between the sample having the diameter difference ΔR1 of 9 mm and the sample having the diameter difference ΔR1 of 10 mm exceeded 40 cm. On the other hand, between the three kinds of the samples having the diameter difference ΔR1 of 9 mm or less, that is, the samples having the diameter differences ΔR1 of 9 mm, 7 mm, and 5 mm, the difference in breakage occurrence height was within 10 cm. Between the samples having the diameter difference ΔR1 of larger than 9 mm, that is, the samples having the diameter differences ΔR1 of 10 mm and 12 mm, the difference in breakage occurrence height was only 5 cm. As described later, this tendency was seen in the sample groups of all the minimum thicknesses t1, although there is a difference in the degree of the tendency between the samples having the minimum thickness t1 of 2.5 mm or less and the samples having the minimum thickness t1 of larger than 2.5 mm.

This reason is not clear. However, for example, since the energy of collision (kinetic energy) increases in proportion to the square of a collision speed, it is thought that if the collision speed reaches a certain speed or higher, breakage suddenly becomes likely to occur. It is thought that a certain degree of the stroke of rotation is required in order that the collision speed of the head portion 41 of the metal terminal 40 that has decelerated due to collision of the metal shell 50 against the upper surface 601 reaches a speed sufficient to cause breakage. Thus, it is thought that when the diameter difference ΔR1 is equal to or less than 9 mm, the collision speed can be reduced, and thus the resistance to breakage of the exposed portion 18A can be greatly improved as compared to the case where the diameter difference ΔR1 is greater than 9 mm.

When a further detailed comparison is made, in the samples having the minimum thickness t1 of 2.5 mm or less, the degree of improvement in resistance to breakage due to the diameter difference ΔR1 being equal to or less than 9 mm was much larger than in the samples having the minimum thickness t1 of larger than 2.5 mm. Specifically, in the samples having the minimum thickness t1 of 2.5 mm or less, that is, in the sample group in which the minimum thickness t1 is 1.5 mm, 1.8 mm, 2.0 mm, 2.2 mm, and 2.5 mm, the difference in breakage occurrence height between the sample having the diameter difference ΔR1 of 9 mm and the sample having the diameter difference ΔR1 of 10 mm was 40 cm to 45 cm. On the other hand, in the samples having the minimum thickness t1 of lager than 2.5 mm, that is, in the sample group in which the minimum thickness t1 is 2.7 mm, 3.0 mm, and 3.2 mm, the difference in breakage occurrence height between the sample having the diameter difference ΔR1 of 9 mm and the sample having the diameter difference ΔR1 of 10 mm was 10 cm to 15 cm.

As is understood from the above description, the following was understood from the drop test of which the results are shown in FIG. 4. From the standpoint of improving the resistance to breakage of the exposed portion 18A of the insulator 10, the diameter difference ΔR1 between the diameter R16 of the circumscribed circle VC of the maximum outer diameter portion 51A of the tool engagement portion 51 and the maximum outer diameter R11 of the head portion 41 of the metal terminal 40 is preferably equal to or less than 9 mm. When the diameter difference ΔR1 is equal to or less than 9 mm, the effect of improvement in resistance to breakage is remarkable particularly if the minimum thickness, in the radial direction, of the portion of the exposed portion 18A which portion is in contact with the trunk portion 43 (i.e., the minimum thickness t1) is equal to or less than 2.5 mm.

In other words, when the minimum thickness t1 is equal to or less than 2.5 mm, the diameter difference ΔR1 is preferably equal to or less than 9 mm. By so setting, even when the minimum thickness t1 is equal to or less than 2.5 mm, since the diameter difference ΔR1 is equal to or less than 9 mm, the shock to the insulator 10 at the time of fall or the like can be alleviated. Therefore, the resistance to breakage of the insulator 10 can be improved.

As described above, it was found from the drop test that the resistance to breakage of the exposed portion 18A improves as the diameter difference ΔR1 is smaller as shown in FIG. 4. Therefore, for example, the diameter difference ΔR1 is more preferably equal to or less than 7 mm.

In addition, the minimum thicknesses t1 with which it was found from the drop test that the effect of improvement in resistance to breakage is remarkable were 1.5 mm, 1.8 mm, 2 mm, and 2.2 mm. Any of these values can be adopted as the upper limit and/or the lower limit of a preferable range of the minimum thickness t1. For example, a value of 2.2 mm or less can be adopted as the minimum thickness t1.

From the standpoint of improvement in resistance to breakage, it is preferable to increase the maximum outer diameter R11 of the head portion 41 for decreasing the diameter difference ΔR1. However, from the standpoint of suppressing so-called flash over, the maximum outer diameter R11 of the head portion 41 is preferably smaller than the maximum outer diameter R13 of the exposed portion 18A as described with reference to FIGS. 2(A) and 2(B).

Figure 5:
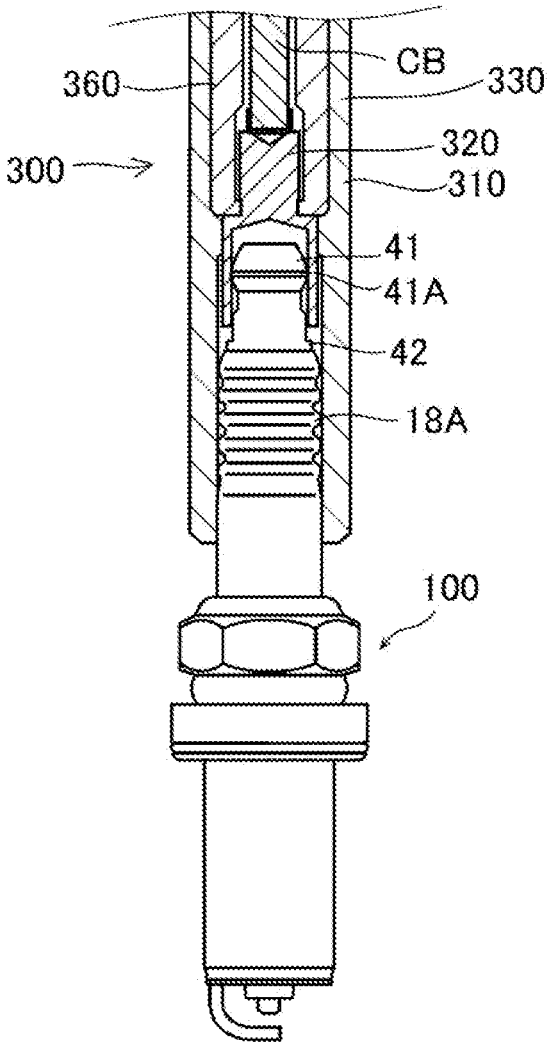
FIG. 5 is a schematic diagram showing a state where a plug cap is mounted on the spark plug 100.

A description will be given with reference to FIG. 5. FIG. 5 is a schematic diagram showing a state where a plug cap is mounted on the spark plug 100. FIG. 5 shows a cross-sectional view of a portion at a side where a plug cap 300 is connected to the spark plug 100. The plug cap 300 includes: a connection metal fitting 320 connected to the metal terminal 40 of the spark plug 100; a main body 360 which is a cylindrical member made of a resin and having a front end into which the connection metal fitting 320 is inserted; and a rubber cover 310 which covers the main body 360 and the connection metal fitting 320. A high-voltage cable CB is connected to the rear end of the connection metal fitting 320. A front portion of the high-voltage cable CB is disposed within the main body 360, and a rear portion (not shown) of the high-voltage cable CB extends from the rear end of the main body 360 to the outside. The rear end of the high-voltage cable CB is connected to a power supply device which is not shown.

As shown in FIG. 5, the head portion 41 of the metal terminal 40 of the spark plug 100 is connected to the connection metal fitting 320 of the plug cap 300. The outer peripheral surface of the exposed portion 18A of the spark plug 100 is in contact with the inner peripheral surface of a front portion of the rubber cover 310. In this type of the plug cap, the outer peripheral surface of the exposed portion 18A and the inner peripheral surface of the rubber cover 310 are in contact with each other, thereby suppressing flash over. The flash over is a problem that on a path passing through the outer peripheral surface of the exposed portion 18A, a current leaks between the metal terminal 40 and the metal shell 50.

It is assumed that by increasing the maximum outer diameter R11 of the head portion 41 (the outer diameter of the portion 41B), the maximum outer diameter R11 of the head portion 41 becomes the maximum outer diameter of the metal terminal 40 and the maximum outer diameter R11 of the head portion 41 becomes larger than the maximum outer diameter R13 of the exposed portion 18A. In this case, the diameter of a front portion of the connection metal fitting 320 in FIG. 5 has to be made larger than the maximum outer diameter R13 of the exposed portion 18A. As a result, the inner diameter of a portion of the rubber cover 310 which portion covers the exposed portion 18A has to be large. Therefore, the adhesion between the outer peripheral surface of the exposed portion 18A and the inner peripheral surface of the rubber cover 310 reduces, and thus the effect of suppressing flash over diminishes.

As is understood from the above description, if the maximum outer diameter R11 of the head portion 41 is made smaller than the maximum outer diameter R13 of the exposed portion 18A (R13>R11) as in the spark plug 100 in FIGS.

2(A) and 2(B), a reduction in the adhesion between the outer peripheral surface of the exposed portion 18A and the inner peripheral surface of the rubber cover 310 can be suppressed to suppress occurrence of flash over.

From the standpoint of improvement in the resistance to breakage, it is preferable if the diameter difference ΔR1 is smaller. However, from the standpoint of ensuring airtightness of the spark plug 100, the diameter difference ΔR1 is preferably equal to or greater than 5 mm.

If the diameter difference ΔR1 is made smaller than 5 mm by increasing the maximum outer diameter R11 of the head portion 41 (the outer diameter of the portion 41B), since R13>R11, the diameter difference (R16−R13) between the diameter R16 of the circumscribed circle VC of the maximum outer diameter portion 51A and the maximum outer diameter R13 of the exposed portion 18A is also smaller than 5 mm. Accordingly, the region between the crimp portion 53 of the metal shell 50 and the outer peripheral surface of the exposed portion 18A (the region filled with the line packings 6 and 7 and the talc 9 (FIGS. 2(A) and 2(B))) cannot be ensured as a sufficient region. As a result, the crimp portion 53 cannot be crimped with a sufficient strength. Accordingly, the adhesion between the insulator 10 and the metal shell 50 via the plate packing 8 reduces, and thus there is a possibility that airtightness of the spark plug 100 cannot be ensured.

As is understood from the above description, if the diameter difference ΔR1 is made greater than 5 mm (ΔR1≥5 mm) as in the spark plug 100 in FIGS. 2(A) and 2(B), an excessive decrease in the diameter difference between the outer diameter of the tool engagement portion 51 and the outer diameter of the exposed portion 18A can be suppressed, thus fixing (specifically, fixing by means of crimping) of the insulator 10 to the metal shell 50 can be appropriately performed, and further airtightness of the spark plug can be ensured.

B. Second Embodiment

B-1. Configuration at Rear Side of Spark Plug 100*b*

Figure 6:
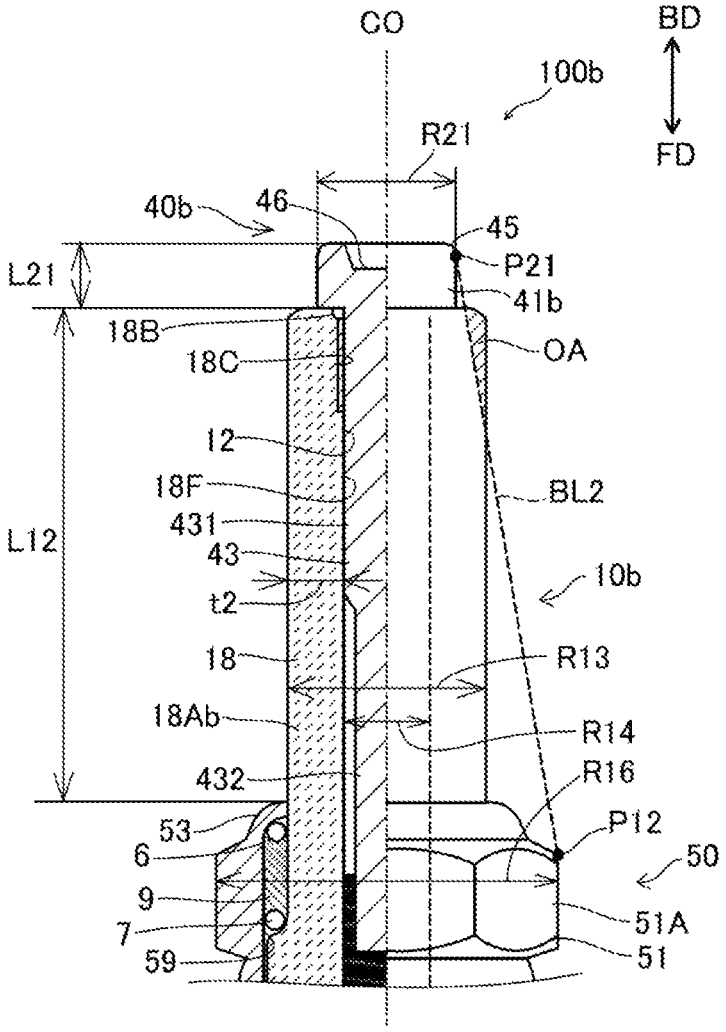
FIG. 6 is a view showing a configuration at a rear side of a spark plug 100*b* according to a second embodiment.

The spark plug 100*b* according to the second embodiment is different from the spark plug 100 according to the first embodiment in FIGS. 1 and 2, in a part of the configuration at the rear side. The other configuration of the spark plug 100*b* are the same as that of the spark plug 100 according to the first embodiment in FIGS. 1 and 2. FIG. 6 is a view showing the configuration at the rear side of the spark plug 100*b* according to the second embodiment. Of the components of the spark plug 100*b*, the same components as those of the spark plug 100 according to the first embodiment are designated by the same reference numerals as those in the spark plug 100 in FIGS. 2(A) and 2(B), and the description thereof is omitted.

No groove is formed on the outer peripheral surface of an exposed portion 18Ab of an insulator 10*b* of the spark plug 100*b* in FIG. 6. The other configuration of the exposed portion 18Ab is the same as that of the exposed portion 18A according to the first embodiment.

In the case where no groove is formed on the outer peripheral surface of the exposed portion 18Ab as described above, a minimum thickness t2 of the exposed portion 18Ab is slightly different from the minimum thickness t1 in the first embodiment. The minimum thickness t2 is the minimum value of the thickness, in the radial direction, of a portion of the exposed portion 18Ab which portion is in contact with the trunk portion 43 (the portion 18F of the exposed portion 18Ab in the example of FIG. 6). The minimum thickness t2 is t2=(R13−R14)/2. The minimum outer diameter of the portion of the exposed portion 18Ab which portion is in contact with the trunk portion 43 is equal to the maximum outer diameter R13 of the exposed portion 18Ab, since no groove is formed on the surface thereof.

A head portion 41*b* of a metal terminal 40*b* of the spark plug 100*b* in FIG. 6 is different in configuration from the head portion 41 according to the first embodiment. The other configuration of the metal terminal 40*b* is the same as that of the metal terminal 40 according to the first embodiment. The head portion 41*b* according to the second embodiment has a shorter length L21 in the axial direction than that of the head portion 41 according to the first embodiment. The outer diameter of the head portion 41*b* according to the second embodiment is uniform except for a portion in which a chamfer 45 is formed. Therefore, a maximum outer diameter R21 of the head portion 41*b* according to the second embodiment is the outer diameter of a portion other than the portion in which the chamfer 45 is formed. The rear end surface of the head portion 41*b* has a bottomed hole 46. The bottomed hole 46 is a portion for causing a connection metal fitting (not shown) for supplying a high voltage to the metal terminal 40 to be in contact therewith. The maximum outer diameter R21 of the head portion 41*b* is smaller than the maximum outer diameter R13 of the exposed portion 18Ab. A diameter difference ΔR2=(R13−R21) between the maximum outer diameter R13 of the exposed portion 18Ab and the maximum outer diameter R21 of the head portion 41*b* is equal to or greater than 1 mm (ΔR2≥1 mm). For example, when the maximum outer diameter R13 of the exposed portion 18Ab is 9 mm, the maximum outer diameter R21 of the head portion 41*b* is set to 8 mm or less.

Here, a virtual line BL2 which connects the rear end of a portion having the maximum outer diameter of the head portion 41*b* (i.e., a portion excluding the chamfer 45) and the rear end of the maximum outer diameter portion 51A to each other at a shortest distance is a broken line connecting a point P21 and a point P12 to each other in the cross-section shown in FIG. 6. In the spark plug 100*b* according to the second embodiment, the virtual line BL2 intersects the exposed portion 18Ab. In other words, in the second embodiment, the exposed portion 18Ab includes a portion OA located outside a truncated cone obtained by rotating the virtual line BL2 in the cross-section shown in FIG. 6 about the axial line CO.

B-3: Evaluation Test

In an evaluation test, a drop test for a plurality of kinds of samples of spark plugs (also referred to as evaluation samples) was carried out for confirming resistance to breakage of the insulator 10*b* of the spark plug 100*b* according to the second embodiment described above.

The items common to each evaluation sample used in the test are as follows.

Maximum outer diameter R13 of the exposed portion 18Ab: 9 mm.

Length L12 of the exposed portion 18Ab in the axial direction: 33.2 mm.

Length L21 of the head portion 41*b* of the metal terminal 40 in the axial direction: 3.3 mm.

Material of the insulator 10*b*: a ceramic material composed of 90% by weight of $Al_2O_3$ and 10% by weight of a sintering aid ($SiO_2$, CaO, MgO, BaO).

As the evaluation samples, samples in which the minimum thickness t2 of the exposed portion 18Ab was set to eight kinds of thicknesses, that is, to 1.5 mm, 1.8 mm, 2.0 mm, 2.2 mm, 2.5 mm, 2.7 mm, 3.0 mm, and 3.2 mm, respectively were prepared. The minimum thickness t2 was changed by changing the diameter R14 of the axial hole 12 of the exposed portion 18Ab.

Furthermore, regarding the samples having the respective minimum thicknesses t2, samples in which the diameter difference ΔR2=(R13−R21) between the maximum outer diameter R13 of the exposed portion 18Ab and the maximum outer diameter R21 of the head portion 41 was set to five kinds of values, that is, 1 mm, 1.5 mm, 2.3 m, 2.5 mm, and 2.8 mm, respectively were prepared. The diameter difference ΔR2 was changed by changing the maximum outer diameter R21 of the head portion 41*b* of the metal terminal 40. Regarding each kind of the sample, when the maximum outer diameter R21 of the head portion 41*b* was changed, the diameter R16 of the circumscribed circle VC of the maximum outer diameter portion 51A of the tool engagement portion 51 was adjusted such that the virtual line BL2 intersected the exposed portion 18Ab.

The combination of the maximum outer diameter R21 of the head portion 41*b* and the diameter R16 of the circumscribed circle VC of the maximum outer diameter portion 51A in each kind of the sample is as follows.

Samples of ΔR2=1 mm: (R21=8 mm, R16=11 mm)
Samples of ΔR2=1.5 mm: (R21=7.5 mm, R16=11 mm)
Samples of ΔR2=2.3 mm: (R21=6.7 mm, R16=16 mm)
Samples of ΔR2=2.5 mm: (R21=6.5 mm, R16=16 mm)
Samples of ΔR2=2.8 mm: (R21=6.2 mm, R16=16 mm)

As described above, 40 kinds of samples different from each other in at least one of the minimum thickness t2 and the diameter difference ΔR2 were prepared.

The drop test was carried out by the same method as in the evaluation test for the spark plug 100 according to the first embodiment (see FIG. 3), and a breakage occurrence height of each sample was identified. The breakage that occurred in the exposed portion 18Ab of the sample was breakage (also referred to as longitudinal breakage) in which a crack runs from the rear end of the exposed portion 18Ab along the axial direction.

Figure 7:
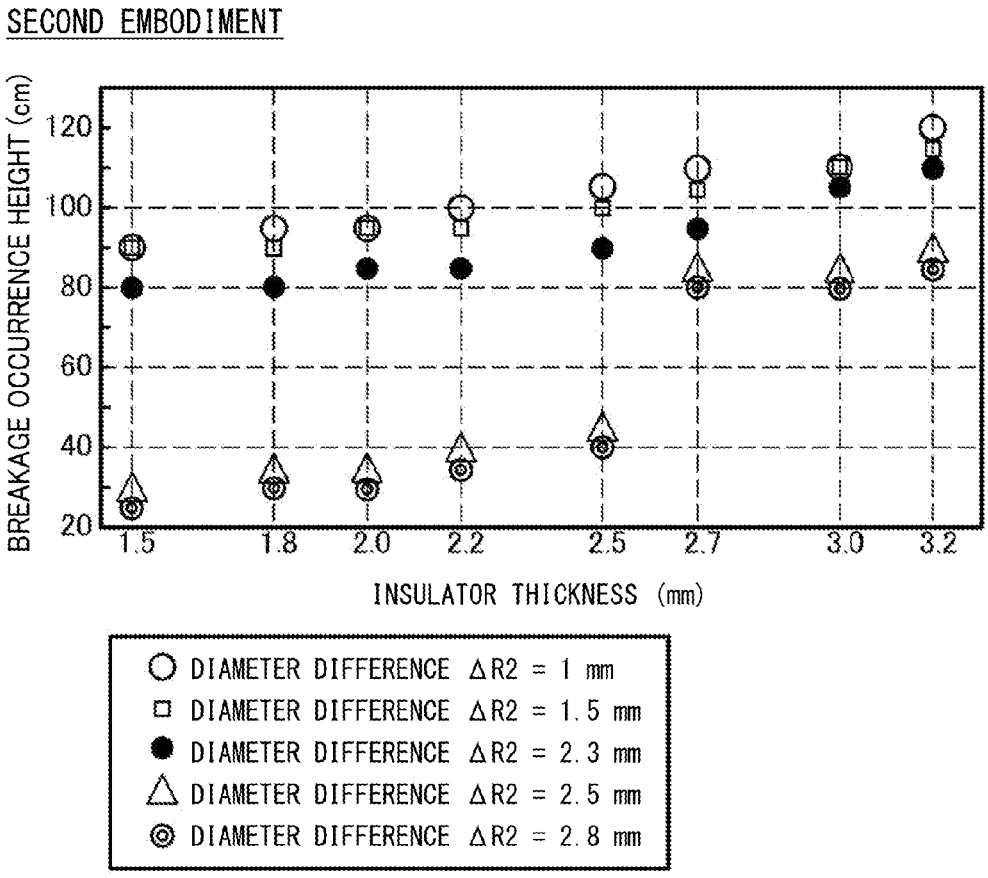
FIG. 7 is a graph showing test results.

FIG. 7 is a graph showing test results. When eight kinds of samples that are the same in the diameter difference ΔR2 and different from each other in the minimum thickness t2 are compared, the samples having the larger minimum thickness t2 tended to have a higher breakage occurrence height. That is, when the diameter differences ΔR2 were equal to each other, the samples having the larger minimum thickness t2 had higher resistance to breakage. This tendency was common to the sample groups of all the diameter differences ΔR2.

In addition, when five kinds of samples that are the same in the minimum thickness t2 and different from each other in the diameter difference ΔR2 are compared, the breakage occurrence height tended to be higher as the diameter difference ΔR2 was smaller. That is, when the minimum thicknesses t2 were equal to each other, the resistance to breakage was higher as the diameter difference ΔR2 was smaller. This tendency was common to the sample groups of all the minimum thicknesses t2.

This reason is inferred as follows. Breakage occurs in the exposed portion 18Ab when a shock in the radial direction is applied mainly to the exposed portion 18Ab. This is because the thickness of the exposed portion 18Ab in the radial direction is much smaller than the length thereof in the axial direction. When the head portion 41*b* of the metal terminal 40 receives a shock and this shock is applied in the radial direction to the exposed portion 18Ab from the inside of the exposed portion 18Ab via the trunk portion 43, breakage occurs more easily than when the side surface of the exposed portion 18Ab locally receives a shock. The case where a shock in the radial direction is applied to the head portion 41 of the metal terminal 40 is mainly the case where the sample falls with the axial direction being substantially horizontal as in the present drop test. Here, in each sample, as described above, the virtual line BL2 (FIG. 6) intersects the exposed portion 18Ab. Therefore, in this case, first, the tool engagement portion 51 of the metal shell 50 collides against the upper surface 601 of the metal plate 600. Thereafter, the sample rotates with the maximum outer diameter portion 51A of the tool engagement portion 51 as a fulcrum, so that the portion OA (FIG. 6) at the outer side of the virtual line BL2 of the exposed portion 18Ab collides against the upper surface 601. Then, furthermore, the sample rotates with the portion OA as a fulcrum, so that the head portion 41*b* of the metal terminal 40 collides against the upper surface 601 of the metal plate 600. As the stroke of the rotation after the collision of the portion OA until the collision of the head portion 41*b* of the metal terminal 40 is longer, the collision speed of the head portion 41 is higher, and the shock of the collision is also greater. As the diameter difference ΔR2 is smaller, the stroke of the rotation after the collision of the portion OA until the collision of the head portion 41*b* of the metal terminal 40 is shorter. As a result, as the diameter difference ΔR2 is smaller, the shock in the radial direction applied to the head portion 41*b* of the metal terminal 40 is smaller. Thus, it is thought that as the diameter difference ΔR2 is smaller, the resistance to breakage is higher.

Furthermore, five kinds of samples that are the same in the minimum thickness t2 will be compared in detail. The samples having the diameter difference ΔR2 of 2.3 mm or less had much higher resistance to breakage than the samples having the diameter difference ΔR2 of larger than 2.3 mm. For example, attention will be paid to the sample group of the minimum thickness t2=1.5 mm. In this sample group, the difference in breakage occurrence height between the sample having the diameter difference ΔR2 of 2.3 mm and the sample having the diameter difference ΔR2 of 2.5 mm exceeded 40 cm. On the other hand, between the three kinds of samples having the diameter difference ΔR2 of 2.3 mm or less, that is, the samples having the diameter differences ΔR2 of 2.3 mm, 1.5 mm, and 1 mm, the difference in breakage occurrence height was within 15 cm. Between the samples having the diameter difference ΔR2 of larger than 2.3 mm, that is, the samples having the diameter differences ΔR2 of 2.5 mm and 2.8 mm, the difference in breakage occurrence height was only 5 cm. As described later, this tendency was seen in the sample groups of almost all the minimum thicknesses t2, although there is a difference in the degree of the tendency between the samples having the minimum thickness t2 of 2.5 mm or less and the samples having the minimum thickness t2 of larger than 2.5 mm.

This reason is not clear. However, for example, since the energy of collision (kinetic energy) increases in proportion to the square of a collision speed, it is thought that if the collision speed reaches a certain speed or higher, breakage suddenly becomes likely to occur. It is thought that a certain degree of the stroke of rotation is required in order that the collision speed of the head portion 41*b* of the metal terminal 40 that has decelerated due to collision of the metal shell 50 against the upper surface 601 and further collision of the exposed portion 18Ab against the upper surface 601 reaches a speed sufficient to cause breakage. Thus, it is thought that when the diameter difference ΔR2 is equal to or less than 2.3 mm, the collision speed can be reduced, and thus the resistance to breakage of the exposed portion 18Ab can be greatly improved as compared to the case where the diameter difference ΔR2 is greater than 2.3 mm.

When a further detailed comparison is made, in the samples having the minimum thickness t2 of 2.5 mm or less, the degree of improvement in resistance to breakage due to the diameter difference ΔR2 being equal to or less than 2.3 mm was much larger than in the samples having the minimum thickness t2 of larger than 2.5 mm. Specifically, in the samples having the minimum thickness t2 of 2.5 mm or less, that is, in the sample group in which the minimum thickness t2 is 1.5 mm, 1.8 mm, 2.0 mm, 2.2 mm, and 2.5 mm, the difference in breakage occurrence height between the sample having the diameter difference ΔR2 of 2.3 mm and the sample having the diameter difference ΔR2 of 2.5 mm was 45 cm to 50 cm. On the other hand, in the samples having the minimum thickness t2 of lager than 2.5 mm, that is, in the sample group in which the minimum thickness t2 is 2.7 mm, 3.0 mm, and 3.2 mm, the difference in breakage occurrence height between the sample having the diameter difference ΔR2 of 2.3 mm and the sample having the diameter difference ΔR2 of 2.5 mm was 10 to 20 cm.

As is understood from the above description, the following was understood from the drop test of which the results are shown in FIG. 7. From the standpoint of improving the resistance to breakage of the exposed portion 18Ab of the insulator 10*b*, the diameter difference ΔR2 between the maximum outer diameter R13 of the exposed portion 18Ab of the insulator 10*b* and the maximum outer diameter R21 of the head portion 41*b* of the metal terminal 40 is preferably equal to or less than 2.3 mm. When the diameter difference ΔR2 is equal to or less than 2.3 mm, the effect of improvement in resistance to breakage is remarkable particularly if the minimum thickness t2 is equal to or less than 2.5 mm.

In other words, when the minimum thickness t2 is equal to or less than 2.5 mm, the diameter difference ΔR2 is preferably equal to or less than 2.3 mm. By so setting, even when the minimum thickness t2 is equal to or less than 2.5 mm, since the diameter difference ΔR2 is equal to or less than 2.3 mm, the shock to the insulator 10*b* at the time of fall or the like can be alleviated. Therefore, the resistance to breakage of the insulator 10*b* can be improved.

As described above, it was found from the drop test that the resistance to breakage of the exposed portion 18Ab improves as the diameter difference ΔR2 is smaller as shown in FIG. 7. Therefore, for example, the diameter difference ΔR2 is more preferably equal to or less than 1.5 mm.

In addition, the minimum thicknesses t2 with which it was found from the drop test that the effect of improvement in resistance to breakage is remarkable were 1.5 mm, 1.8 mm, 2 mm, and 2.2 mm. Any of these values can be adopted as the upper limit and/or the lower limit of a preferable range of the minimum thickness t2. For example, a value of 2.2 mm or less can be adopted as the minimum thickness t2.

From the standpoint of improvement in resistance to breakage, it is preferable if the diameter difference ΔR2 is smaller. However, from the standpoint of suppressing flash over, the diameter difference ΔR2 is preferably equal to or greater than 1 mm.

As described with reference to FIG. 5, when the spark plug 100*b* is connected to the plug cap 300, the outer peripheral surface of the exposed portion 18Ab and the inner peripheral surface of the rubber cover 310 are in contact with each other, whereby flash over is suppressed.

It is assumed that by increasing the maximum outer diameter R21 of the head portion 41*b*, the diameter difference ΔR2 becomes less than 1 mm. In this case, due to variations within tolerance during manufacture, a part of the outer peripheral surface of the head portion 41*b* may protrude radially outward of the outer peripheral surface of the exposed portion 18Ab. As a result, the inner diameter of a portion of the rubber cover 310 which portion covers the exposed portion 18Ab increases. Therefore, the adhesion between the outer peripheral surface of the exposed portion 18Ab and the inner peripheral surface of the rubber cover 310 reduces, and thus the effect of suppressing flash over diminishes.

As is understood from the above description, if the diameter difference ΔR2 is made equal to or greater than 1 mm ((R13−R21)≥1 mm) as in the spark plug 100 in FIG. 6, a reduction in the adhesion between the outer peripheral surface of the exposed portion 18Ab and the inner peripheral surface of the rubber cover 310 can be suppressed to suppress occurrence of flash over.

C. Modified Embodiments (1) Although the grooves 18D are formed on the exposed portion 18A of the spark plug 100 according the first embodiment described above (FIGS. 2(A) and 2(B)), no groove may be formed thereon similarly to the exposed portion 18Ab of the spark plug 100*b* according to the second embodiment (FIG. 6). In this case, the minimum thickness t1 in the spark plug 100 according to the first embodiment is defined similarly to the minimum thickness t2 in the second embodiment. On the other hand, the grooves 18D may be formed on the exposed portion 18Ab of the spark plug 100*b* according to the second embodiment, similarly to the exposed portion 18A of the spark plug 100 according to the first embodiment. In this case, the minimum thickness t2 in the spark plug 100*b* according to the second embodiment is defined similarly to the minimum thickness t1 in the first embodiment.

(2) Although the insulators 10 and 10*b* each are formed by using the ceramic material containing $Al_2O_3$ as a principal component in the first and second embodiments described above, the insulators 10 and 10*b* each may be formed by using a ceramic material containing another compound as a principal component instead. For example, the insulators 10 and 10*b* each may be formed by using a ceramic material containing any one of AlN, $ZrO_2$, SiC, $TiO_2$, and $Y_2O_3$ as a principal component. Even with the insulators 10 and 10*b* formed from these materials, resistance to breakage of the insulators 10 and 10*b* can be improved according to the present embodiment.

(3) Although the configuration at the rear side of the spark plug has been mainly described above in each embodiment, the other elements, for example, the configuration at the rear side of the spark plug, the materials, the dimensions, and the like of the metal shell 50, the metal terminal 40, the ground electrode 30, and the like may be variously changed. For example, the firing end of the spark plug may be a type having a gap opposed in a direction perpendicular to the axial line, or may be a plasma jet type in which plasma generated by ignition within an auxiliary chamber is emitted to the outside. The material of the metal shell 50 may be low-carbon steel that is plated with zinc, nickel, or the like or may be low-carbon steel that is not plated therewith.

Although the present invention has been described above based on the embodiments and the modified embodiments, the above-described embodiments of the invention are intended to facilitate understanding of the present invention, but not as limiting the present invention. The present invention can be changed and modified without departing from the gist thereof and the scope of the claims and equivalents thereof are encompassed in the present invention.

DESCRIPTION OF REFERENCE NUMERALS

5: gasket
6: line packing

8: plate packing
9: talc
10, 10*b*: insulator
12: axial hole
13: leg portion
16: step portion
17: front trunk portion
18: rear trunk portion
18A, 18Ab: exposed portion
18D: groove
18E: rear end surface
19: flange portion
20: center electrode
21: center electrode body
23: head portion
24: flange portion
25: leg portion
29: center electrode tip
30: ground electrode
31: ground electrode body
39: ground electrode tip
40, 40*b*: metal terminal
41, 41*b*: head portion
41A: groove
42: flange portion
43: trunk portion
46: bottomed hole
50: metal shell
51: tool engagement portion
51A: maximum outer diameter portion
52: mounting screw portion
53: crimp portion
54: seat portion
56: step portion
58: compressive deformation portion
59: through hole
60: conductive seal
70: resistor
80: conductive seal
100, 100*b*: spark plug
BL1, BL2: virtual line

The invention claimed is:

1. A spark plug comprising:

a metal shell including a tool engagement portion for engaging a mounting tool, the metal shell having a through hole extending therethrough in a direction of an axial line;

an insulator disposed in the through hole of the metal shell and having an axial hole extending in the direction of the axial line; and a metal terminal including: a trunk portion disposed in the axial hole of the insulator; a flange portion having a larger diameter than the trunk portion and in contact with a rear end surface of the insulator; and a head portion having a smaller diameter than the flange portion and located at a rear side of the flange portion, wherein a virtual line between a rear end of a maximum outer diameter portion of the head portion and a rear end of a maximum outer diameter portion of the tool engagement portion defines a shortest distance between the two rear ends, the maximum outer diameter portion of the tool engagement portion is a portion where a circumscribed circle of the tool engagement portion has a largest diameter, the virtual line does not intersect an exposed portion of the insulator, which is exposed from the metal shell toward the rear side, the exposed portion has a contact portion that contacts the trunk portion, and a minimum thickness in a radial direction of the contact portion is equal to or less than 2.5 mm, and a diameter difference between the maximum outer diameter of the tool engagement portion and the maximum outer diameter of the head portion is equal to or less than 9 mm.

2. The spark plug according to claim 1, wherein the maximum outer diameter of the head portion is smaller than a maximum outer diameter of the exposed portion.

3. The spark plug according to claim 1, wherein the diameter difference between the maximum outer diameter of the tool engagement portion and the maximum outer diameter of the head portion is equal to or greater than 5 mm.

4. A spark plug comprising:

a metal shell including a tool engagement portion for engaging a mounting tool, the metal shell having a through hole extending therethrough in a direction of an axial line;

an insulator disposed in the through hole of the metal shell and having an axial hole extending in the direction of the axial line; and a metal terminal including: a trunk portion disposed in the axial hole of the insulator; and a head portion having a larger diameter than the trunk portion and in contact with a rear end surface of the insulator, wherein a virtual line between a rear end of a maximum outer diameter portion of the head portion and a rear end of a maximum outer diameter portion of the tool engagement portion defines a shortest distance between the two rear ends, the maximum outer diameter portion of the tool engagement portion is a portion where a circumscribed circle of the tool engagement portion has a largest diameter, the virtual line intersects an exposed portion of the insulator, which is exposed from the metal shell toward the rear side, the exposed portion has a contact portion that contacts the trunk portion, and a minimum thickness in a radial direction of the contact portion is equal to or less than 2.5 mm, and a diameter difference between a maximum outer diameter of the exposed portion and the maximum outer diameter of the head portion is equal to or less than 2.3 mm.

5. The spark plug according to claim 4, wherein the maximum outer diameter of the head portion is smaller than the maximum outer diameter of the exposed portion, and the diameter difference between the maximum outer diameter of the exposed portion and the maximum outer diameter of the head portion is equal to or greater than 1 mm.

6. The spark plug according to claim 2, wherein the diameter difference between the maximum outer diameter of the tool engagement portion and the maximum outer diameter of the head portion is equal to or greater than 5 mm.

* * * * *